United States Patent [19]

Grinsteiner

[11] Patent Number: 4,934,323

[45] Date of Patent: Jun. 19, 1990

[54] VALVE LEVER WITH BALL BEARING PIVOT AND RETAINER

[75] Inventor: James J. Grinsteiner, Roselle, Ill.

[73] Assignee: Navistar International Transporation Corp., Chicago, Ill.

[21] Appl. No.: 213,023

[22] Filed: Dec. 12, 1988

[51] Int. Cl.[5] ..... F01L 1/18

[52] U.S. Cl. ..... 123/90.42; 123/90.41

[58] Field of Search ..... 123/90.39, 90.41, 90.42, 123/90.44

[56] References Cited

U.S. PATENT DOCUMENTS

| | | | |
|---|---|---|---|
| Re. 16,205 | 11/1925 | Asbury | 123/90.41 |
| 1,521,623 | 1/1925 | Hendrickson | 123/90.39 |
| 1,557,548 | 10/1925 | Asbury | 123/90.41 |
| 1,588,041 | 6/1926 | Moore . | |
| 1,612,792 | 1/1927 | Asbury . | |
| 1,699,657 | 1/1929 | Fagan | 123/90.39 |
| 1,902,696 | 1/1933 | Eimer | 123/90.39 |
| 2,970,585 | 2/1961 | Lombardi . | |
| 3,016,887 | 1/1962 | Streit et al. . | |
| 3,251,350 | 5/1966 | Thompson . | |
| 3,274,983 | 9/1966 | Herring | 123/90.42 |
| 3,563,215 | 2/1971 | Ross | 123/90.42 |
| 4,132,196 | 1/1979 | Wherry | 123/90.39 |
| 4,393,820 | 7/1983 | Maki et al. | 123/90.41 |
| 4,440,121 | 3/1984 | Clancy et al. | 123/90.39 |
| 4,598,674 | 8/1986 | Nono et al. | 123/90.41 |
| 4,653,441 | 3/1987 | Belsanti | 123/90.39 |
| 4,676,203 | 6/1987 | Novno | 123/90.42 |
| 4,763,616 | 8/1988 | Grinsteiner | 123/90.41 |
| 4,765,290 | 8/1988 | Tanaka | 123/90.42 |

*Primary Examiner*—Willis R. Wolfe
*Assistant Examiner*—M. Macy
*Attorney, Agent, or Firm*—F. David AuBuchon; Dennis K. Sullivan

[57] ABSTRACT

A relatively thin, post-mounted valve lever having a ball bearing pivot for operating an intake or exhaust valve of an internal combustion engine and having a lateral bearing surface which slidably engages aligned spaced lateral surfaces on a wide supporting post which maintain the rocking plane within the valve lever. A retainer is disposed on the top side of the post and extends into the central opening in the valve lever to prevent the rocker arm, post, and ball bearing from becoming disassembled.

6 Claims, 2 Drawing Sheets

VALVE LEVER WITH BALL BEARING PIVOT AND RETAINER

CROSS-REFERENCE TO RELATED APPLICATION

This application is related to U.S. patent application Ser. No. 065,814, filed June 23, 1987 and assigned to the assignee hereof and now U.S. Pat. No. 4,763,616.

1. Background of the Invention

This invention relates to a rocker arm on an internal combustion engine and more particularly to the valve rocker arm with a ball bearing pivot to operate an intake or exhaust valve of an internal combustion engine and a retainer for maintaining the valve lever, pivot and post as an assembly.

2. The Prior Art

In the conventional low-speed engine the design of the rocker arm or valve rocker arm is not critical. High speed engines and supercharged engines present a problem of space limitations and inertia forces on the valve train not normally experienced with the conventional low-speed engine. Accordingly, the rocker arm of the modern high-speed engine should be designed for greater efficiency, smooth operation and to reduce inertia forces in the valve train. The Asbury patent, U.S. Pat. No. 1,612,792, shows a rocker arm assembly for operating a valve on an internal combustion engine. This rocker arm does employ a spherical element or ball at the fulcrum point for pivoting of the rocker arm. The ratio of operation of the rocker arm does not appear to remain constant since the spherical element can roll on the surface between the pins on the rocker arm. The general construction of the rocker arm is not similar to that of the applicant's invention.

The Moore patent, U.S. Pat. No. 1,588,041, also shows a rocker arm assembly in which the ratio of the rocker arm is intentionally designed to vary the rate of opening initially relative to subsequent ratio of the rocker arm. This is to provide a greater mechanical ratio initially and a faster opening later on. The fulcrum point and the structure between the rocker arm and the push rod as well as the rocker arm and the valve stem are not similar to the applicant's invention.

Wherry patent, U.S. Pat. No. 4,132,196 shows a relatively thin section rocker arm. However, Wherry is not post mounted, but rather is mounted on a rocker arm shaft and the portion of Wherry providing mounting on that shaft is not at all thin.

SUMMARY OF THE INVENTION

The applicant has provided a post-mounted low inertia rocker arm in which the rocker arm has a slender configuration but substantial depth to assure stiffness for transmission of force from the push rod to the valve stem. The design of the applicant's invention provides low inertia forces in the valve train and an efficient operation of the valve on a ball pivoting fulcrum. Accordingly, the applicant's invention is believed to be distinguishable over these rocker arms.

Accordingly, it is an object of this invention to provide a post-mounted low inertia and lightweight rocker arm for an internal combustion engine.

It is another object of this invention to provide a low inertia and lightweight rocker arm with stiffness for transmitting the actuating force from the push rod to the valve stem.

It is a further object of this invention to provide a low inertia rocker arm with a ball bearing pivot at the fulcrum point for efficient operation of the valve rocker arm.

It is a further object of this invention to provide a lightweight, low inertia rocker arm for operating in an engine of limited space availability and having minimum inertia stress in the valve train.

A still further object of the invention is to provide a means for maintaining the rocker arm, pivot ball, and support post as an assembly during installation or removal from the engine.

The objects of this invention are accomplished with a rocker arm pivotally mounted on a ball bearing fulcrum. A push rod end forms a ball received in a socket of the rocker arm for operating the rocker arm while a curved surface on the opposite end of the rocker arm operates against a valve stem. The rocker arm is of thin construction with sufficient depth to provide stiffness for transmitting the operating force from the push rod to the valve stem. The arm bears laterally on a wide mounting post which pivotally supports the rocker arm to maintain the pivoting plane of the rocker arm so that the forces operate within the dimensions of the rocker arm. The ball and socket fulcrum provide an efficient pivot point and the lateral surface bearing maintains the alignment of the pivoting plane of the rocker arm. The thin construction of the rocker arm reduces inertia forces and stresses in the valve train. A retainer is inserted in the rocker arm central opening above the upper side of the mounting post to prevent the parts from disassembling.

DESCRIPTION OF THE DRAWINGS

Referring to the drawings.

Figure 6:
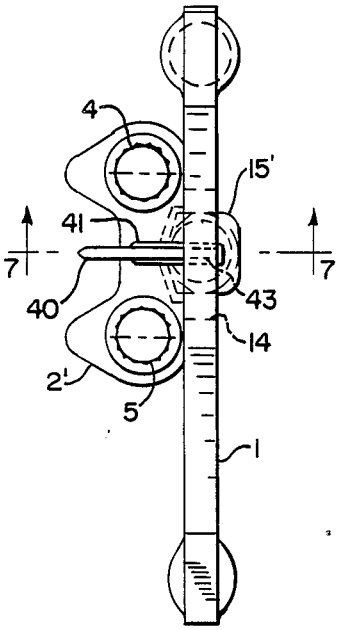
FIG. 6 is a plan view of a third embodiment of the invention incorporating a retainer clip to maintain the valve lever as an assembly during installation and removal of the valve lever assembly from the engine.

Engine 7 is a cross-sectional view of the embodiment of FIG. 6 taken through the fulcrum point of the rocker arm.

DETAILED DESCRIPTION OF THE INVENTION

Figure 5:
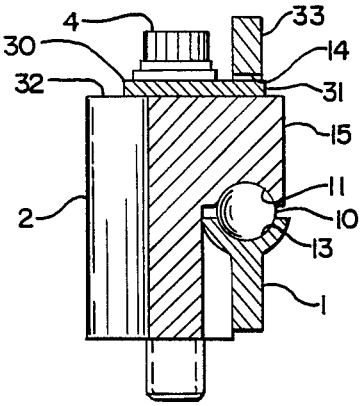
FIG. 5 is a cross-sectional view of the embodiment of FIG. 4 taken through the fulcrum point of the rocker arm.
Figure 7:
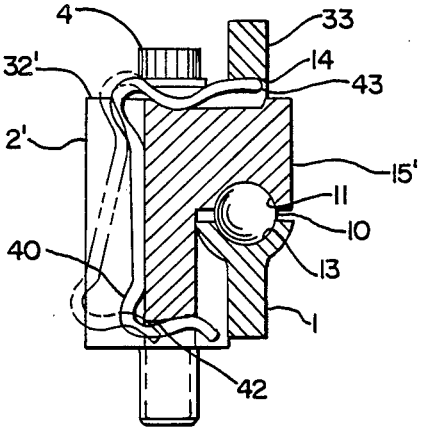

Referring to the drawings, the rocker arm 1 is pivotally supported on a wide post 2. The post 2 is mounted on the engine head 3 and fastened by the bolts 4 and 5. A push rod 6 is operated by a suitable cam shaft not shown. The push rod 6 includes a spherical end 7 operating against a spherical seat 8 in the end of the rocker arm 1. A fulcrum 9 is formed by a ball 10 disposed in fixed position in the spherical socket 11 of the post 2. An insert 12 is permanently seated on the rocker arm 1 and forms a spherical socket 13 which receives the lower portion of the ball 10 and maintains it in fixed position between the ends of the rocker arm, thus maintaining a relatively fixed rocker arm ratio. Alternatively, the spherical socket 13 can be integrally formed in the rocker arm as shown in FIG. 5 and FIG. 7.

The rocker arm 1 forms an opening 14 which receives a bearing support portion 15 of the wide post 2 which projects outwardly from aligned lateral surfaces 23 disposed on both sides of support 15 closely adjacent lateral surface 22 of rocker arm 1.

Figure 1:
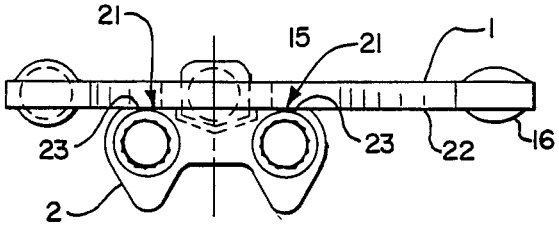
FIG. 1 illustrates a plan view of the valve operating mechanism.
Figure 2:
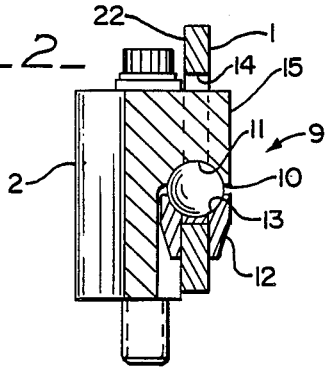
FIG. 2 illustrates a side-elevation view of the valve operating mechanism.
Figure 3:
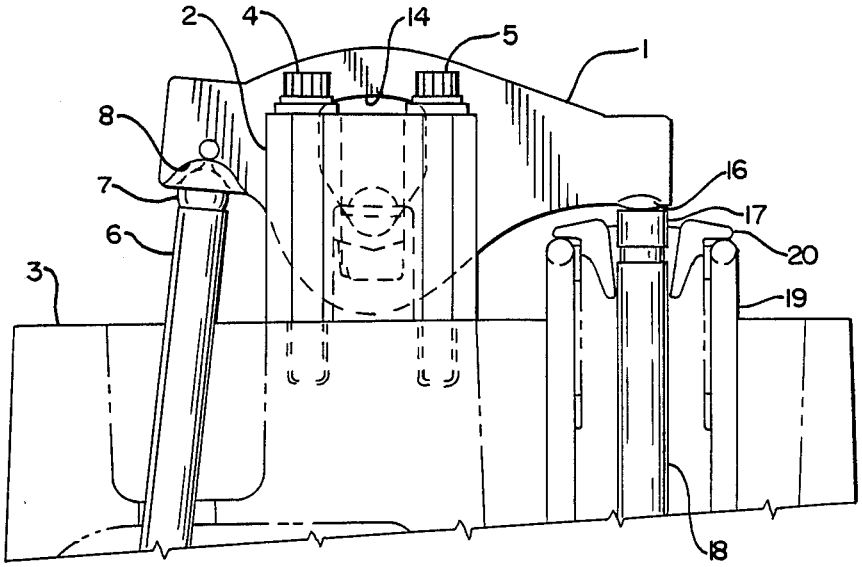
FIG. 3 is a cross-section view of the valve operating mechanism through the fulcrum point of the rocker arm.

The rocker arm 1 forms a convex curved surface 16 which operates the upper end 17 of the valve stem 18. The valve is normally closed by the spring 19 which engages a valve seat 20 on the stem 18 of the valve. Opening of the valve is accomplished by pressing the valve stem 18 downwardly against the force of the spring 19. The push rod 6, normally operated by a cam shaft, is biased upwardly by a cam lobe pivoting the rocker arm 1 in a clockwise direction as viewed in FIG. 2.

The device operates in the following described manner. The rocker arm 1 is pivotally supported on its fulcrum 9 formed by the ball 10 seated in the spherical socket of housing 11 of the wide post 2. The ball also seats in the spherical socket 13 of the insert 12 which is carried on the rocker arm 1. Normally, the rocker arm 1 is pressed upwardly by a cam shaft operating on the push rod 6. A spring 19 engaging the spring seat 20 presses the valve stem 18 upwardly against the convex surface 16. The spring closes the valve when the cam on the cam shaft allows the valve to close, the valve being closed by the spring. The valve is opened by a cam lobe on the cam shaft operating through the push rod to pivot the rocker arm 1 forcing the valve stem 18 downwardly. Rotating of the cam allows the rocker arm 1 to pivot counterclockwise and closes the valve.

The rocker arm 1 is essentially a flat member with a seat engaging a spherical end 7 of the push rod 6 which operates the rocker arm. The opposite end of the rocker arm is formed with a convex surface 16 which engages the end 17 of the valve stem 18. The rocker arm is relatively thin normal to the pivoting plane and lightweight and reduces inertial loading in the valve train mechanism to a minimum. The rocker arm, although relatively thin, is aligned so the forces operate in a pivotal plane within the confines of the rocker arm and the stiffness of the rocker arm is achieved by the depth of the arm per se in the pivoting plane and allows transmission of the force from the push rod 6 to the valve stem 18 without any deformity of the rocker arm. This also provides a rocker arm requiring a limited space. The rocker arm is positioned closely adjacent, on the order of 0.25 mm, to the side of wide post 2 to form bearing interfaces 21 formed by the lateral surface 22 of the rocker arm and the aligned lateral surfaces 23 of the side of the post 2. The surfaces 23 cover a fairly substantial area on both sides of the post 2 and are located at least one bearing diameter away from the center of ball bearing 10 to maintain the pivotal alignment of the rocker arm in operation. Accordingly, the pivotal movement of the rocker arm is controlled by the ball bearing on which the rocker arm pivots as well as the lateral interfaces 21 between the rocker arm and the wide post 2.

THE EMBODIMENT OF FIGS. 4 AND 5

Figure 4:
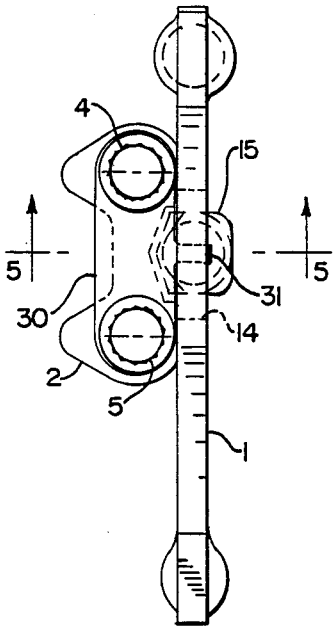
FIG. 4 is a plan view of a second embodiment of the invention incorporating a keeper to maintain the valve lever as an assembly during installation or removal from the engine.

The valve lever assembly of this embodiment is substantially the same as in the previously described embodiment, except as indicated, and functions in the same way. In addition, in this embodiment, a retainer means for maintaining the various pieces as an assembly is provided in the form of keeper 30 disposed on the top side 32 of post 2, as shown in FIGS. 4 and 5. The keeper 30, an elongated plate having holes for closing receiving bolts 4 and 5 therethrough which locate the keeper 30 relative to the post 2, has a laterally projecting finger 31 which extends adjacent to the top side of post portion 15, i.e., the side opposite socket 11, into the clearance in the central opening 14 of the wraparound between the top side 32 of the post 2 and the portion 33 of rocker arm 1 above the central opening 14. The thickness of finger 31 is such that the remaining clearance in opening 14 between the rocker arm portion 33 and the finger 31 is substantially less than the depth of either of the sockets 11 and 13 for valve 10, thereby preventing the rocker arm 1, support post 2, and ball 10 from being disassembled. The keeper 30 and finger 31 are easily maintained in position to prevent disassembly as long as bolts 4 and 5 are in place in post 2 whether or not they have been threaded into the engine heads. Accordingly, the valve lever assembly of this embodiment may be constructed as a unit away from the engine for later installation thereon through the use of a temporary bolt retention means such as wrapping tape around the lower ends of bolts 4 and 5 below post 2. Additionally, if bolts 4 and 5 are maintained in post 2 during removal of the valve lever assembly from the engine, the parts will remain assembled and loose pieces such as ball 10 cannot drop inside the engine.

THE EMBODIMENT OF FIGS. 6 AND 7

In FIGS. 6 and 7, an alternate embodiment of the keeper 30 of the previous embodiment is provided in the form of a spring wire clip 40. The top side 32' of support post 2' is provided with a lateral wire receiving groove 41 and the medial portion of post 2' between the bolts 4 and 5 is undercut on the bottom side as at 42 so that the wire clip may springingly engage the post 2' at 41 and 42 and be retained thereon. The undercut 42 also allows the wire clip to be within the lower overall periphery of post 2' and thus permits the valve lever assembly to be installed on the engine without removing the clip 40. The wire clip 40 when installed has an end 43 projecting into central opening 14 of the rocker arm 1 in the clearance between the top portion 33 of the rocker arm and the top side 32' of post 2' and is sized so that the remaining clearance between the rocker arm portion 33 and portion 43 is less than the depth of either socket 11 or 13 for pivot ball 10. Thus, when the clip 40 is in place, the rocker arm, post, and pivot ball will be maintained as an assembly. Use of the clip 40 as the retention means has the advantage that the means maintaining the valve lever as an assembly is independent of the mounting bolts 4 and 5 and thus, the assembly is unaffected by installation or removal from the engine.

What is claimed is:

1. A valve operating mechanism for an internal combustion engine comprising:

a rocker arm having a central opening and a ball socket opening into said central opening;

a support post having a portion extending into said rocker arm central opening and having a ball socket in said extending portion disposed in confronting relation to said rocker arm ball socket;

a ball bearing disposed in both said rocker arm ball socket and said support post ball socket to form a fulcrum for said rocker arm on said post; and a retainer means disposed on said support post and projecting into said rocker arm opening adjacent the opposite side of said support post portion from said support post ball socket, said retainer means reducing the clearance in said opening between said post and retainer means and said rocker arm to an amount less than the depth of either of said ball sockets.

2. The invention in accordance with claim 1 and said retainer means comprising a keeper disposed on the top side of said support post, said keeper having a projection extending into said rocker arm opening and locating means interconnecting said keeper and said support post for maintaining said projection within said rocker arm opening.

3. The invention in accordance with claim 2 and said locating means comprising mounting bolts extending through said keeper and said post and adapted to mount said post to said engine.

4. The invention in accordance with claim 1 and said retainer means comprising a spring wire clip springingly engaging said support post and having an end portion extending into said rocker arm central opening.

5. The invention in accordance with claim 4 and said support post having a wire receiving lateral groove disposed on its top side receiving and locating a portion of said clip.

6. The invention in accordance with claim 5 and said support post having a lower medial portion undercut to receive a lower portion of said clip.

* * * * *